United States Patent [19]

Benn

[11] 4,388,125

[45] Jun. 14, 1983

[54] CARBURIZATION RESISTANT HIGH TEMPERATURE ALLOY

[75] Inventor: Raymond C. Benn, Suffern, N.Y.

[73] Assignee: The International Nickel Company, Inc., New York, N.Y.

[21] Appl. No.: 224,800

[22] Filed: Jan. 13, 1981

[51] Int. Cl.[3] ..... C22C 19/05

[52] U.S. Cl. ..... 148/428; 148/442; 420/443; 420/584

[58] Field of Search ..... 75/171, 170, 134 F, 75/122; 148/32, 32.5

[56] References Cited

U.S. PATENT DOCUMENTS 3,817,747 6/1974 Schultz et al. ..... 75/171

4,248,629 2/1981 Pons et al. ..... 75/171

FOREIGN PATENT DOCUMENTS 2648968 5/1980 Fed. Rep. of Germany .

*Primary Examiner*—R. Dean

*Attorney, Agent, or Firm*—Miriam W. Leff; Raymond J. Kenny

[57] ABSTRACT

Special heat resistant alloys containing nickel, chromium, iron, titanium, aluminum, carbon, silicon, manganese, calcium and tungsten afford high temperature carburization, oxidation and sulfidation resistance, characteristics which render the alloys particularly suitable for use in contact with such media as hydrocarbons, high sulfur content feed stocks and the like.

26 Claims, No Drawings

CARBURIZATION RESISTANT HIGH TEMPERATURE ALLOY

BACKGROUND OF THE INVENTION

1. Field of the Invention

The present invention relates to heat resistant alloys having excellent high temperature carburization, oxidation (including cyclic oxidation) and sulfidation resistance.

2. Prior Art

It is well known that many industrial processes are operating at temperatures of up to 1800° F. and above, and require equipment made of heat resistant alloys which will exhibit carburization, oxidation and sulfidation resistance at these temperatures. There is also a need for these alloys to have good welding characteristics so as to facilitate fabrication and maintenance of equipment.

One important industrial process that requires heat and corrosion resistant alloys is the production of ethylene by pyrolysis. This pyrolysis is carried out at high temperatures, usually in the range of 1600° F. to 1800° F. in tubular reactors. The combination of high temperature and a hydrocarbon stream produces an environment in which a very serious carburization problem results. As in all industrial processes, long-time maintenance-free operation is an economic necessity and, in this case, the severe carburization problem results in substantially reducing the serviceable life of the equipment unless a suitable alloy is used. Alloys for ethylene pyrolysis furnace tubes must also have good resistance to stresses that can induce creep and rupture at the operating temperatures and good resistance to oxidation and sulfidation attack, especially when impure feedstocks are used.

In addition, advancements in technology, e.g., higher operating temperatures, processing of lower grade feedstocks and the like, will impose more stringent service requirements upon alloys for this application and increase the demands for strong, more corrosion resistant alloys.

I have now discovered a new alloy providing a new combination of characteristics especially suitable in equipment for the production of ethylene by pyrolysis and for other equipment subjected to similar conditions of stress, temperature and corrosive attack.

It is an object of the invention to provide an alloy having a combination of characteristics including excellent resistance to carburization, oxidation, cyclic oxidation and sulfidation attack, good stress-rupture strength at high temperatures, and satisfactory weldability.

Another object of the invention is to provide heat and corrosion resistant alloy products and articles, including products and articles for use in ethylene pyrolysis furnace tubes.

SUMMARY OF THE INVENTION

Generally speaking, the present invention is directed to an alloy containing, by weight, from about 28 to about 35% chromium, from about 10 to about 22% iron, from about 0.1 to about 0.7% titanium, from about 0.2 to 0.75% about carbon, from about 0.5 to about 2% manganese, a minor portion of calcium, from about 0.5 to about 5% tungsten, from 0 to about 2% niobium, from 0 to about 0.6% zirconium, about 2 to about 2.5% aluminum, about 0.4 to about 2% silicon (the sum of the aluminum plus silicon being about 2.6 to about 3.3%) and the balance essentially nickel. As will be understood by those skilled in the art, the use of the expression "balance essentially" in referring to the nickel content of the alloy does not exclude the presence of other elements commonly present as incidental constituents and impurities.

In accordance with the invention, preferred alloys contemplated herein contain, by weight, from about 30 to about 33% chromium, from about 17 to about 20% iron, from about 0.1 to about 0.4% titanium, from about 0.3 to about 0.45% carbon, from about 0.6 to about 0.85% manganese, from about 0.01 to about 0.04% calcium, from about 0.6 to about 2.5% tungsten, from about 0.3 to about 0.7% niobium, from about 0.2 to about 0.4% zirconium, wherein the sum of the total of titanium and zirconium will be about 0.6%, about 2 to 2.5% aluminum, about 0.5 to about 1% silicon, wherein the sum of the aluminum and the silicon is about 3%, and the balance essentially nickel.

DETAILED DESCRIPTION OF THE INVENTION

Alloys of the invention are characterized by a austenitic matrix containing interdendritic eutectic, (chromium-rich) carbide that was darkened by etching with Murakami's reagent. X-ray diffraction identifies this polygonal carbide, which has a Chinese script type of morphology, as predominately $(CrFe)_{23}C_6$. Other carbide particles, predominantly titanium-rich carbonitrides, are present as a fine dispersion throughout both the matrix and within the chromium-rich carbide network. These titanium-rich carbonitrides also serve as nucleation sites for the chromium-rich polygonal carbides. Other carbide-forming elements, such as niobium, tungsten and zirconium may serve the same role and also strengthen the carbide network.

In carrying the invention into practice, nickel is controlled in the amount of at least about 40% to provide a stable face-centered cubic matrix (austenite).

Chromium contributes carburization, oxidation and sulfidation resistance. Chromium levels lower than about 28% result in decreased carburization, oxidation and sulfidation resistance and in an increased tendency for heat-affected-zone cracking during welding. Alloys with 30% or more chromium are considered necessary to provide adequate corrosion-erosion resistance in, for example, coal gasification environments. Alloys which consistently manifest the best combination of creep strength, corrosion resistance and weldability contain chromium in accordance within the range of about 30 to 33%, more preferably 31 to 32%.

Aluminum enhances the carburization, oxidation and sulfidation resistance of the alloy. The excellent carburization resistance is attributed to the pervading presence of aluminum which when allowed to oxidize to alumina in surface regions forms a diffusion barrier to inhibit carbon penetration. In addition chromia and silica may also be present in surface regions to compound the corrosion resistance due to alumina. To maintain the desired carburization resistance, it is essential that the aluminum content be maintained above about 2%. This is the level required for excellent carburization resistance and strength without significantly decreasing the metal fluidity during casting. The preferred level is 2 to 2.5% aluminum. Most preferred is about 2.25%.

Silicon from 0.4% up to about 2%, enhances carburization, oxidation and sulfidation resistance. However, silicon above about 1% adversely affects weldability, stability and 2000° F. rupture strength. It is desirable therefore to incorporate silicon in the range 0.5 to 1% which is also sufficient for good castability. Most preferred is about 0.75%.

Silicon and aluminum, within their respective ranges, may be varied to produce the desired carburization properties provided their sum is about 2.6 to 3.3%; preferably the sum will be about 3%.

Carbon levels in the range 0.2 to 0.75% ensure sufficient metal fluidity during casting and alloy strength. Carbon levels above about 0.45% tend to decrease weldability. Carbon levels in the range 0.3 to about 0.45% are preferred for better microstructural stability; higher levels tend to cause the precipitation of lath-shaped chromium-rich carbides after long term, stressed exposure at elevated temperatures, e.g., 1000 hrs at 1 ksi and 1400° F. This precipitation is in addition to the polygonal chromium-rich carbide structure, the later being present in the as-cast condition, and is manifested as a reduction in alloy ductility. The most preferred range is 0.35–0.4%.

Manganese is present in the alloy to improve weldability at a level of about 0.5 to about 2%. A level in the preferred range of 0.6 to 0.85% is desirable as, apart from an apparent improvement in oxidation resistance, higher levels were generally neutral or deleterious to properties. The most preferred amount is about 0.75%.

Iron above about 22% is thought to cause weld cracking while precentages below about 10%, apart from other factors, unnecessarily increase cost. Iron in the range of about 17 to about 20% is preferred. Most preferred is about 18–19%.

Tungsten in a range of about 0.5 to 5% is required mainly for solid solution strengthening. The preferred range of 0.6 to 2.5% ensures a sufficiently high nickel content in the austenitic matrix to avoid sigma formation, but allows significant strength improvement. The most preferred amount is about 2%.

Titanium is employed as a deoxidizer and denitrifyer. It is present in the microstructure essentially as a dispersion of titanium-rich carbonitride [Ti(CN)] particles. These may also increase the nucleation and precipitation of other carbides, such as $Cr_{23}C_6$, while impede slip and significantly improve the creep rupture strength. A range of 0.1 to 0.7% is used for this purpose.

Zirconium up to about 0.6% and niobium up to about 2% can also be used for this purpose together with the titanium. Titanium, zirconium and niobium may improve weldability.

When zirconium is used in the alloy, it is preferred to use about 0.2 to about 0.4% zirconium and to substitute that portion for some titanium so as to produce a total sum of titanium and zirconium of about 0.5–0.7%. The most preferred is about 0.6%.

When niobium is utilized in the alloy, it is preferable at a level of 0.3 to 0.7% with an optimum of about 0.6% to be used.

Careful control of the deoxidation practice is essential with these aluminum-containing alloys. After and apart from the use of well known deoxidants such as manganese and silicon, the use of a deoxidant such as calcium or magnesium (as a nickel master alloy) to an essentially deoxidized/desulfurized is considered critical for the successful melting/casting practice. The preferred residual content of calcium should lie in the range 0.01% to 0.04% to obtain the desired properties in the casting. In particular, this residual calcium appears to be beneficial to melt fluidity, weldability and hot corrosion resistance, e.g., oxidation/carburization resistance.

Commercial alloys embodying the present invention may also contain small amounts of other elements such as sulfur, phosphorus, copper, molybdenum and cobalt. Sulfur and phosphorus, for example, should be maintained at levels consistent with good steel-making practice; levels less than 0.030 and 0.045%, respectively.

For the purpose of giving those skilled in the art a better understanding of the invention, the following examples are given. Table 1 sets forth the compositions of alloys 1 through 12 which are examples of alloys within the invention and alloys A, B and C which are commercially available alloys.

As mentioned previously, the foundry practice used to produce alloys within this invention is important. The alloys may be vacuum melted in an electric induction furnace. However, for commercial reasons, primarily lower cost, the alloys were produced using the following air melt and sand cast practice. Nickel, iron, low carbon ferrochromium and tungsten were charged into an electric induction furnace. A lime/cryolite slag mixture in the approximate proportions 2½:1 respectively was added to provide a protective cover against oxidation during melting. The charge was heated to 2850° F. and the melt then allowed to cool to about 2750° F. At this point, the manganese, silicon, high carbon chromium and half the aluminum addition were made. The melt was then cooled to 2700° F. and the remainder of the aluminum added followed by the niobium addition as required. The melt temperature was then raised to about 2925° F., the slag cover removed as necessary and a nickel-calcium addition made. The titanium or titanium plus zirconium addition, wrapped in nickel foil, was made to a ladle that had been preheated to about 2400° F. The melt was tapped immediately into the ladle and the titanium/titanium plus zirconium addition stirred in as necessary. A thermocouple was inserted and the melt cast immediately when the temperature reached about 2750° F. Castings made from each heat included dry sand molded 4-inch thick keel blocks (about 55 pounds) which were sectioned to remove pipe and then machined using a standarized cut-up procedure to locate test blanks for evaluation. In addition, fluidity spirals and segmented plate castings (e.g., Chinese puzzles) were cast in green sand molds to assess the castability of the alloys. It should be noted that improved fluidity does not necessarily indicate improved castability, since the latter covers, in addition to fluidity, the ability of the molten metal front to divide and reunite satisfactorily as experienced in filling a cored mold. However, trials with cored molds indicated a good correlation between fluidity and castability of alloys within the invention.

The creep-rupture results set forth in Table II were obtained using standard testing procedures. The specimens were first creep-rupture tested followed by room temperature measurement of elongation and reduction of area.

The carburization tests set forth in Table III were run at 2000° F. in a flowing gas mixture of hydrogen containing 12 volume percent methane and 10 volume percent water. The specimens were supported in ceramic fixtures and then inserted into a preheated tube furnace which had been flushed with argon. Following the argon flush, the hydrogen-methane-water-gas mixture was introduced at a velocity of 500 cm/min over the specimens. At the end of each test period, the furnace was again flushed with argon and the specimens were removed to cool in air. The specimens were then lightly descaled to remove the oxide formed as the specimens were taken from the furnace, and the weight change of the specimens were measured. The radial penetration measurement was the depth of metal showing carbon penetration and was measured metallographically on a Leitz measuring microscope. All specimens were etched in Murakami's reagent prior to making the measurements. All the tests were run for a period of 100 hours. The radial penetration are based on samples having a diameter of 7.60 mm.

The sulfidation tests set forth in Table III were run in a flowing gas mixture of hydrogen containing 45 volume $CO_2$ and 0.4 volume percent hydrogen sulfide at 1800° F. for 240 hours. The same testing procedure as that described above for the carburization tests were used.

The oxidation tests set forth in Table III were run in flowing air containing a controlled 5 volume percent water vapor at 2000° F. The air velocity over the specimens was 250 cm/min. The tests were cyclic in that the specimens were removed from the furnace every 24 hours, cooled to room temperature, weighed and returned to the furnace. A total test time of 504 hours was employed. The test specimens were descaled at the end of the test.

The comparison of the properties of the alloys of the current invention and the commercially available alloys in Table II clearly reflects the superiority of creep rupture characteristics at 1400° F. of the alloy of the current invention.

A comparison of the carburization resistance, sulfidation resistance and oxidation resistance in Table III clearly shows the superiority to resistance of the alloys of the current invention over the alloys commercially available.

The weldability of the alloys of the invention is demonstrated by tests conducted on Alloys 1 through 12. Plates of Alloys 1 through 5 were surface ground to ⅜" thick ×4" square, gas tungsten-arc welded for automatic circular bead-on-plate tests and visually examined at 10× for evidence of weld and heat-affected zone defects. The plates were clamped rigid during the test to place the weld under constraint. The circular bead-on-plate test was conducted at 10 volts, 200 amperes, with one pass at a travel speed of 8 inches per minute (ipm) and an argon flow of 35 cubic feet per hour (cfh). Each test was conducted using a non-consumable tungsten electrode (⅛" diameter) and no filler material. In the bead-on-plate test there was no evidence of defects except minor crater cracking. Crater cracking, as will be appreciated by those skilled in the art is, in part, a function of the skill exercised in making the weld and, even if they do occur during the welding operation, are normally melted out.

Plates of Alloys 6 through 12 were surface ground to ¾" thick ×4" square, gas tungsten-arc welded for automatic linear bead-on-plate tests and visually examined at 10× for evidence of weld and heat-affected zone defects. The plates were clamped rigid during the test to place the weld under constraint. This bead-on-plate test was conducted at 10 volts, 250 amperes, with one pass at a travel speed of 16 ipm and argon flow of 35 cfh. Each test was conducted using a non-consumable tungsten electrode (⅛" diameter) and no filler material. Evidence of defects was found only in Alloy 8 which showed one weld crack. Alloy 8 has, in particular, lower titanium and calcium levels than, say Alloy 9. This observation indicates that titanium and calcium should be present in the alloy at or above minimum levels of about 0.1% and 0.01% respectively for good weldability.

Plates of Alloys 6, 7 and 9 through 12 were surface ground to 1" thick × about 4" square and a U-shaped groove (7/16" radius) machined into the thickness of each plate for a depth of 7/16" with a minimum length of 2". Each plate was then manually gas tungsten-arc welded using commercial welding rod (SS 310-40-15 high carbon) as filler (⅛" diameter). The weld was conducted at 24 volts, 100 amperes D.C. reverse polarity in 16 passes with no preheat or postheat and maximum inter-pass temperature of 200° F. The joints were radiographically inspected and then cut into ½" wide transverse slices, polished, etched with Lepito's reagent and examined at 10× for weld and heat-affected zone defects. These examinations revealed that only the high carbon Alloys 6 and 7 showed any defects (e.g. cracks). These observations indicated that carbon levels below about 0.45% are preferred for good weldability in these alloys.

The alloys of the present invention are especially useful in applications involving the processing of hydrocarbons and sulfidizing and oxidizing materials at high temperatures, up to at least 2000° F. They can be employed in many other applications, including high temperature application, where resistance to corrosion and good creep and rupture properties are required. Alloys of the invention may be wrought or preferably cast. Exemplary articles made from the alloys include ethylene pyrolysis furnace tubes, piping, valves, vessels and other equipment used in industrial chemical plants.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

TABLE I

| Alloy # | Ni | Cr | Fe | Ti | C | Al | Si | Mn | Ca | W | Nb | Zr |
|---|---|---|---|---|---|---|---|---|---|---|---|---|
| 1 | Bal | 31.4 | 17.9 | 0.63 | 0.40 | 2.30 | 0.73 | 0.77 | 0.027 | 0.62 | — | — |
| 2 | Bal | 31.1 | 17.2 | 0.64 | 0.40 | 2.31 | 0.75 | 0.77 | 0.027 | 1.7 | — | — |
| 3 | Bal | 31.6 | 16.8 | 0.21 | 0.39 | 2.31 | 0.70 | 0.79 | 0.029 | 1.7 | — | 0.33 |
| 4 | Bal | 31.5 | 17.3 | 0.23 | 0.39 | 2.27 | 0.68 | 0.77 | 0.039 | 0.65 | 0.67 | 0.34 |
| 5 | Bal | 31.0 | 17.0 | 0.20 | 0.39 | 2.32 | 0.72 | 0.78 | 0.028 | 1.7 | 0.67 | 0.32 |
| 6 | Bal | 31.9 | 17.2 | 0.18 | 0.50 | 2.10 | 0.59 | 0.75 | 0.020 | 1.9 | 0.34 | 0.30 |
| 7 | Bal | 31.5 | 17.3 | 0.14 | 0.55 | 2.17 | 0.67 | 0.75 | 0.015 | 1.9 | 0.37 | 0.27 |
| 8 | Bal | 30.1 | 18.7 | 0.11 | 0.32 | 2.11 | 0.71 | 0.78 | 0.009 | 1.9 | 0.35 | 0.31 |
| 9 | Bal | 32.0 | 18.6 | 0.16 | 0.32 | 2.16 | 0.73 | 0.79 | 0.012 | 2.0 | 0.36 | 0.29 |
| 10 | Bal | 31.8 | 18.2 | 0.17 | 0.38 | 2.23 | 0.71 | 0.77 | 0.012 | 2.0 | 0.37 | 0.35 |
| 11 | Bal | 31.7 | 19.3 | 0.10 | 0.37 | 2.18 | 0.73 | 0.77 | 0.012 | 1.9 | 0.37 | 0.25 |

TABLE I-continued

| Alloy # | Ni | Cr | Fe | Ti | C | Al | Si | Mn | Ca | W | Nb | Zr |
|---|---|---|---|---|---|---|---|---|---|---|---|---|
| 12 | Bal | 32.2 | 18.4 | 0.40 | 0.32 | 2.16 | 0.72 | 0.80 | 0.013 | 2.2 | — | — |
| A | Bal | 32.5 | 18.2 | 0.52 | 0.079 | 2.9 | 0.53 | — | 0.0008 | — | — | — |
| B | 20.5 | 26.1 | Bal | — | 0.40 | — | 1.1 | 0.86 | 0.0008 | — | — | — |
| C | 32.0 | 20.9 | Bal | 0.50 | 0.06 | 0.10 | 0.30 | 0.90 | 0.0010 | — | — | — |

Balance may contain small amounts of incidental elements not otherwise reported in this Table.

TABLE II

CREEP RUPTURE PROPERTIES OF ALLOYS

| Alloy | Test A Rupture Time (Hrs) 1400° F./19,000 psi | Test A El % | Test A R.A. % | Test B Rupture Time (Hrs) 1800° F./4,500 psi | Test B El % | Test B R.A. % | Test C Rupture Time (Hrs) 2000° F./2,500 psi | Test C El % | Test C R.A. % |
|---|---|---|---|---|---|---|---|---|---|
| 1 A | 202.1 | 8.0 | 16.2 | 48.7 | 33.0 | 48.5 | 41.0 | 40.8 | 55.7 |
| B | 154.7 | 17.0 | 33.2 | — | — | — | 59.3 | 53.0 | 43.8 |
| 2 A | 183.5 | 18.0 | 42.7 | 60.1 | 24.0 | 43.0 | 77.5 | 28.8 | 44.6 |
| B | 226.1 | 14.0 | 29.9 | 99.5 | 26.0 | 35.4 | 78.7 | 37.0 | 52.6 |
| 3 | 121.0 | 17.0 | 38.9 | — | — | — | 73.2 | 42.0 | 49.3 |
| 4 A | 588.0 | 11.0 | 35.2 | — | — | — | 33.4 | 34.4 | 64.3 |
| B | 636.6 | 10.0 | 21.9 | — | — | — | 49.1 | 55.0 | 66.6 |
| 5 A | 595.8 | 10.0 | 17.5 | 47.9 | 31.0 | 62.4 | 33.9 | 45.0 | 69.0 |
| B | 679.1 | 10.0 | 14.8 | — | — | — | 40.3 | 38.0 | 62.4 |
| 6 | 471.6 | 17.0 | 25.7 | 118.1 | 28.0 | 47.1 | 102.08 | 35.0 | 42.6 |
| 7 | 351.6 | 13.0 | 25.0 | 42.0 | 26.0 | 66.5 | 32.8 | 27.0 | 59.9 |
| 8 | 230.4 | 12.8 | 32.7 | 62.2 | 28.0 | 56.8 | 31.2 | 35.2 | 69.3 |
| 9 | 429.8 | 9.0 | 16.2 | 108.5 | 47.0 | 47.5 | 161.7 | 44.0 | 59.3 |
| 10 | 263.7 | 12.0 | 22.4 | 96.4 | 34.0 | 58.4 | 126.6 | 50.0 | 56.0 |
| 11 | 294.1 | 12.0 | 29.4 | 107.7 | 21.0 | 39.2 | 41.7 | 41.0 | 43.5 |
| 12 | 79.7 | 15.0 | 24.6 | 52.1 | 25.0 | 29.5 | 88.6 | 25.0 | 36.5 |
| A | 150.0 | 2.0 | 5.0 | — | — | — | 35.0 | 50.0 | 60.0 |
| B | 100.0 | 7.0 | 10.2 | 100.0 | — | — | 125.0 | 5.0 | 10.1 |
| C | 54.0 | 22.0 | 60.5 | — | — | — | — | — | — |

Note:
EL % = Elongation Percentage; R.A. % = Reduction in Area Percent

TABLE III

| Alloy | Carburization Resistance Weight Change (mg/cm²) | Carburization Resistance Penetration (mm) | Sulfidation Resistance Weight Change (mg/cm²) | Oxidation Resistance Weight Change (mg/cm²) Undescaled | Oxidation Resistance Weight Change (mg/cm²) Descaled |
|---|---|---|---|---|---|
| 1 | 7.025 | 0.30 | 1.225 | −10.993 | −15.280* |
| 2 | 1.791 | 0.30 | 3.216 | −9.928 | −13.706* |
| 3 | 4.164 | 0.30 | 0.384 | −4.665 | −7.977* |
| 4 | 9.293 | 0.30 | −4.527 | −18.619 | −20.951* |
| 5 | 8.379 | 0.26 | 1.065 | −19.796 | −21.754* |
| A | 2.2 | 0.10 | 2.818 | −22.39 | −25.42 |
| B | 22.129 | 3.8 | Destroyed in less than 72 Hrs | −124.15 | −127.93 |
| C | 14.73 | 3.8 | Destroyed in less than 140 Hrs | −133.52 | −138.05 |

*Tight adherent scale

I claim:

1. A nickel-base heat resistant alloy consisting essentially of, by weight, chromium, from about 28 to about 35%; iron, from about 10 to about 22%; titanium, from about 0.1 to about 0.7%; carbon, from about 0.2 to about 0.75%; manganese, from about 0.5 to about 2%; calcium, present up to about 0.04%; tungsten, from about 0.5 to about 5%; aluminum, from about 2 to about 2.5%; silicon, from about 0.4 to about 2%; and nickel, the balance, said alloy being characterized by a microstructure containing titanium-rich carbonitride particles.

2. A nickel-base heat resistant alloy consisting essentially of, by weight, chromium, from about 30 to about 33%; iron, from about 17 to about 20%; titanium, from about 0.1 to about 0.5%; carbon, from about 0.3 to about 0.45%; manganese, from about 0.6 to about 0.85%; calcium, from about 0.01 to about 0.04%; tungsten, from about 0.6 to about 2.5%; niobium, from about 0.3 to about 0.7%; zirconium, from about 0.2 to about 0.4%; aluminum, from about 2 to about 2.5%; silicon, from about 0.5 to about 1%; and nickel, the balance, said alloy being characterized by a microstructure containing titanium-rich carbonitride particles.

3. The alloy of claim 2 wherein the sum of aluminum and silicon is about 2.6 to about 3.3%, by weight.

4. The alloy of claim 2 wherein the sum of aluminum and silicon is about 3%.

5. The alloy of claim 2 wherein the sum of zirconium and titanium is about 0.5 to about 0.7%.

6. A nickel base heat resistant alloy consisting essentially of, by weight, chromium, 31 to 32%; aluminum, about 2.25%; silicon, about 0.75%; carbon, 0.35–0.4%; manganese, about 0.75%; iron, 18–19%; tungsten, about 2%; titanium, 0.1 to about 0.5%; zirconium, about 0.2 to about 0.4%; wherein the sum of titanium and zirconium is about 0.6%; niobium, about 0.6%; calcium, residual of about 0.01 to 0.04%; and nickel, the balance, said alloy being characterized by a microstructure containing titanium-rich carbonitride particles.

7. A nickel-base heat resistant alloy consisting essentially of, by weight, chromium, from about 28 to 35%; iron, from about 10 to 22%, titanium, from about 0.1 to about 0.7%; carbon, from about 0.2 to about 0.75%; manganese, from about 0.5 to about 2%; calcium, present up to about 0.04%; tungsten, from about 0.5 to about 5%; aluminum, from about 2 to about 2.5%; silicon, from about 0.4 to about 2%; niobium, up to about 2%; zirconium, up to about 0.6%, and the balance essentially nickel; said alloy being characterized by a microstructure containing titanium-rich carbonitride particles.

8. The alloy of claim 7 wherein the sum of the aluminum and silicon is about 2.6 to about 3.3%.

9. The alloy of claim 7 wherein the sum of the titanium and zirconium is about 0.5 to about 0.7%.

10. A cast nickel-base heat resistant alloy consisting essentially of, by weight, chromium, from about 28 to 35%; iron, from about 10 to about 22%, titanium, from about 0.1 to about 0.7%; carbon, from about 0.2 to about 0.75%; manganese, from about 0.5 to about 2%; calcium, from about 0.01 to about 0.04%; tungsten, from about 0.5 to about 5%; aluminum, from about 2 to about 2.5%; silicon, from about 0.4 to about 2%; niobium, up to about 2%; zirconium, up to about 0.6%, and the balance essentially nickel; said alloy being characterized by fluidity during casting, by good castability, and by a microstructure containing titanium-rich carbonitride particles.

11. The cast alloy of claim 10, wherein the cast alloy has been made by an air melting and sand casting practice.

12. A multi-stage process for air melting and casting a nickel-base heat resistant, carburization resistant alloy of predetermined composition containing chromium, iron, aluminum, manganese, tungsten, carbon, silicon, calcium, and at least one of the elements selected from the group consisting of titanium, niobium and zirconium, comprising melting a charge material consisting essentially of chromium, iron, aluminum, manganese, silicon, carbon, tungsten, and niobium (if required), and a part of the nickel components of the predetermined alloy composition under a protective cover with respect to the atmosphere, said charge material being formed from components in the form of at least one of the group elements, alloys, and combinations thereof; removing the protective cover; adding to the melt a nickel-calcium alloy, the calcium being sufficient to provide a residual calcium level in the cast alloy and the total nickel in the melt and the nickel-calcium alloy being sufficient to provide the predetermined amount of nickel in the alloy; immediately after incorporating the nickel-calcium into the melt and immediately prior to casting the alloy incorporating the titanium and/or zirconium component (if required) of the predetermined alloy into the calcium containing melt, and immediately thereafter casting the resultant melt.

13. A multi-stage process of claim 12, wherein the melting is carried out in an electric induction furnace.

14. A multi-stage process of claim 12, wherein the protective cover is removed immediately prior to incorporating the required calcium, titanium and/or zirconium.

15. A multi-stage process for air melting a nickel-base heat resistant, carburization resistant alloy of a predetermined composition containing chromium, iron, aluminum, manganese, tungsten, carbon, silicon, calcium, and at least one of the elements selected from the group consisting of titanium, niobium and zirconium comprising providing a protective cover on a charge material, said charge material consisting essentially of at least part of the iron and tungsten components of the composition and a portion of the nickel, carbon and chromium components, said charge material being formed from components in the form of at least one of the group elements, alloys and combinations thereof; melting the charge material which has been provided with a protective cover; adding to the melt under the protective cover chromium, carbon, manganese and silicon in an amount to provide the concentrations in the composition and at least part of the aluminum required in such composition and then adding the balance of the aluminum (if required) and niobium (if required) in the composition, said additions to the melt being in the form of at least one of the group elements, alloys and combinations thereof; removing the slag composition from the melt; adding calcium to the melt, said calcium addition being in the form of a nickel-calcium alloy and at least sufficient to provide a residual calcium in the alloy; immediately after adding the nickel-calcium alloy into the melt and immediately prior to casting the alloy incorporating the titanium and/or zirconium component required in the composition, said a titanium and/or zirconium being added in a form which will permit it to react with the melt and adding any additional nickel to provide the amount required in the composition.

16. The multi-stage process of claim 15, wherein the carbon component of the initial charge material is added as a low carbon ferrochromium alloy.

17. The multi-stage process of claim 16, wherein the remainder of the carbon constituent of the composition is added to the melt after the protective cover is provided and the initial charge material is melted.

18. The multi-stage process of claim 17, wherein the remainder of the carbon constituent of the composition is added as a high carbon chromium material.

19. The multi-stage process of claim 15, wherein the protective cover is a lime/cryolite slag mixture.

20. The multi-stage process of claim 15, wherein the titanium and/or zirconium is added wrapped in metal foil.

21. The multi-stage process of claim 19, wherein the metal foil comprises nickel.

22. The multi-stage process of claim 15, wherein the air melted composition is cast by a sand casting technique.

23. A multi-stage process of claim 12 or 15, wherein the predetermined alloy composition consists essentially of by weight, chromium, from about 28 to about 35%; iron, from about 10 to about 22%; titanium, from about 0.1 to about 0.7%; carbon, from about 0.2 to about 0.75%; manganese, from about 0.5 to about 2%; calcium, present up to about 0.04%; tungsten, from about 0.5 to about 5%; aluminum, from about 2 to about 2.5%; silicon, from about 0.4 to about 2%; and nickel, the balance.

24. The alloy of claim 7 wherein the sum of the aluminum and silicon is about 2.6 to about 3.3%, by weight.

25. The alloy of claim 7 wherein the sum of the zirconium and titanium is 0.5–0.7%, by weight.

26. The alloy of claim 7 wherein the balance of nickel is at least 40%, by weight.

* * * * *